United States Patent [19]

Lancaster, III et al.

[11] 4,079,565

[45] * Mar. 21, 1978

[54] STRETCH-WRAPPED PACKAGE, PROCESS AND APPARATUS

[75] Inventors: Patrick R. Lancaster, III; William G. Lancaster, both of Louisville, Ky.

[73] Assignee: Lantech Inc., Louisville, Ky.

[ * ] Notice: The portion of the term of this patent subsequent to Feb. 25, 1992, has been disclaimed.

[21] Appl. No.: 454,477

[22] Filed: Mar. 25, 1974

[51] Int. Cl.[2] ..... B65B 13/10

[52] U.S. Cl. ..... 53/3; 53/30 R; 53/184 R; 53/198 R

[58] Field of Search ..... 53/3, 27, 30, 184, 196, 53/198 R, 218; 242/75.2, 75.43, 75.44, 75.45; 128/165, 169; 100/27

[56] References Cited

U.S. PATENT DOCUMENTS

| | | | |
|---|---|---|---|
| 1,329,311 | 1/1920 | Roberts | 53/30 X |
| 1,380,837 | 6/1921 | Replugle | 242/75.2 |
| 2,423,294 | 7/1947 | Colesworthy | 53/30 X |
| 2,770,284 | 11/1956 | Myrick | 242/7.22 X |
| 2,972,844 | 2/1961 | Ripley | 53/198 R |
| 3,003,297 | 10/1961 | Broadhead | 100/27 X |
| 3,232,551 | 2/1966 | Rathman | 242/75.45 |
| 3,239,994 | 3/1966 | Etzel | 53/198 R |
| 3,266,082 | 8/1966 | Brandi | 242/75.2 X |
| 3,480,012 | 11/1969 | Smithers | 128/165 |
| 3,495,375 | 2/1970 | Burhop | 53/33 |
| 3,589,091 | 6/1971 | Cloud | 53/184 X |
| 3,596,434 | 8/1971 | Zelnick | 53/198 R |
| 3,793,798 | 2/1974 | Lancaster | 53/196 X |
| 3,867,806 | 2/1975 | Lancaster | 53/30 X |
| 3,910,005 | 10/1975 | Thimon et al. | 53/198 R X |

*Primary Examiner*—Othell M. Simpson
*Assistant Examiner*—John Sipos
*Attorney, Agent, or Firm*—Gipple & Hale

[57] ABSTRACT

This invention provides an apparatus and process for making a unitary package which comprises a load that has a band formed of plural layers of a stretched material wrapped around it.

The apparatus comprises a frame with a rotatable drive shaft driven by a drive mechanism, an arm secured to the drive shaft and a roll holding shaft rotatably mounted to the arm. A sensor device measures the thickness of a material roll placed on the roll holding shaft to control an electromagnetic brake mechanism mounted on the roll holding shaft to variably engage the roll holding shaft thus maintaining a constant tension on the film unwrapped from the roll.

The steps of the process are placing a load on a support; locating a rolled-up sheet of a stretchable material on dispenser roll adjacent to the support; withdrawing a leading edge of the material from the dispenser roll and holding the leading edge of the material against the load. Relative movement between the dispenser roll and the support means is initiated but is restricted so that the material will be stretched with a sufficient amount of the stretched material being dispensed from the dispenser roll to provide a band comprising plural layers of the stretchable material around the load.

8 Claims, 4 Drawing Figures

STRETCH-WRAPPED PACKAGE, PROCESS AND APPARATUS

BACKGROUND OF THE INVENTION

This invention relates to packaging and, more particularly, to a process for making a unitary package which comprises a load that has a band formed of plural layers of a stretched material wrapped around it. The present invention is also concerned with the product produced by such a process and to certain apparatus which can be utilized to perform the process.

The present invention is directed toward further developments of that previously described in our co-pending, commonly assigned U.S. patent application Ser. No. 347,873, filed Apr. 4, 1973, now U.S. Pat. No. 3,867,806, which is incorporated in full herein by reference.

SUMMARY OF THE INVENTION

The present invention provides a process for making a unitary package which comprises a load that has a band formed of plural layers of a stretched material wrapped around it.

Basically, the process comprises the steps of: placing a load on a support; locating a rolled-up sheet of a stretchable material on dispenser means adjacent to the support; withdrawing a leading edge of the material from the dispenser means and holding the leading edge against the load; and initiating relative movement between the dispenser means and the support means but restricting the relative movement such that the material will be stretched and causing a sufficient amount of the stretched material to be dispensed from the dispenser means to provide a band comprising plural layers of the material around the load.

The present invention is also directed toward a product that is produced by the process and to certain apparatus which can be utilized to perform this process.

BRIEF DESCRIPTION OF THE DRAWINGS

The present invention is illustrated in the accompanying drawings wherein.

DETAILED DESCRIPTION

Figure 1:
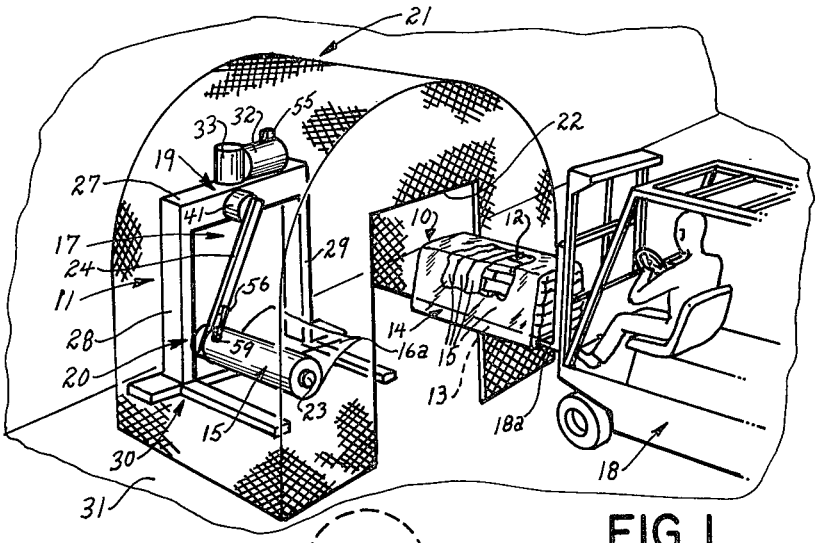
FIG. 1 is a somewhat schematic, partly broken, fragmentary elevational perspective view showing a presently preferred form of apparatus (surrounded by a protective guard) that can be utilized in performing the novel process of the present invention to produce its novel unitary package, which comprises a load that has a band formed of plural layers of a stretched material wrapped around it, and illustrates the apparatus just following completion of the process.

Referring now to the drawings, and more particularly to FIG. 1 thereof, there is illustrated, with parts broken away for purposes of illustration, a typical product, a unitary package 10, which can be produced in accordance with the novel process that is provided in accordance with the present invention. While it should be understood that various means could be employed, FIGS. 1–4 of the drawings illustrate a form of apparatus 11 that has been used with good results in carrying out the novel process of the present invention to produce the product 10.

Figure 2:
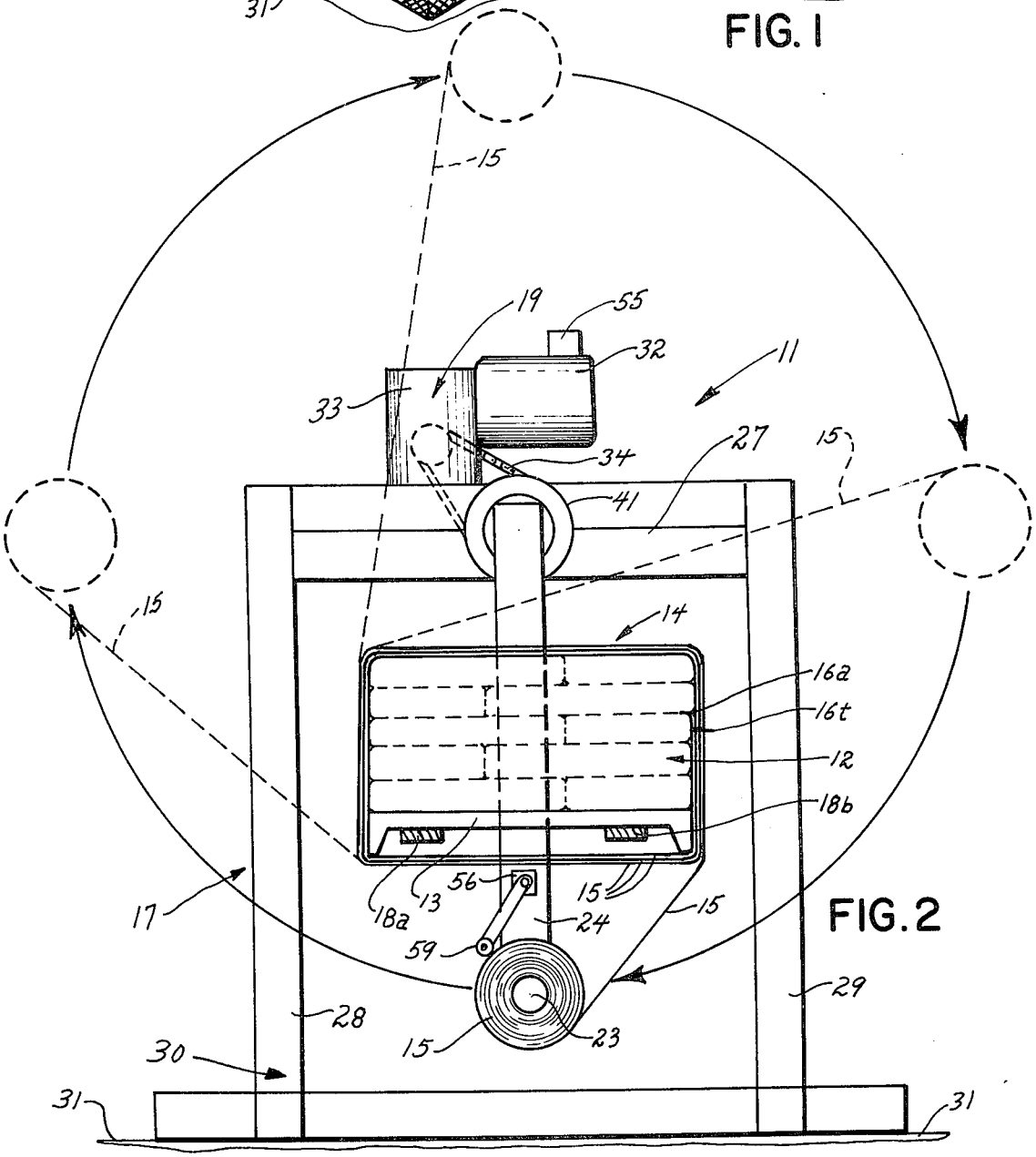
FIG. 2 is a somewhat schematic, greatly enlarged fragmentary front elevational view showing in detail the construction and operation of the apparatus shown in FIG. 1, with the protective guard being removed therefrom.
Figure 3:
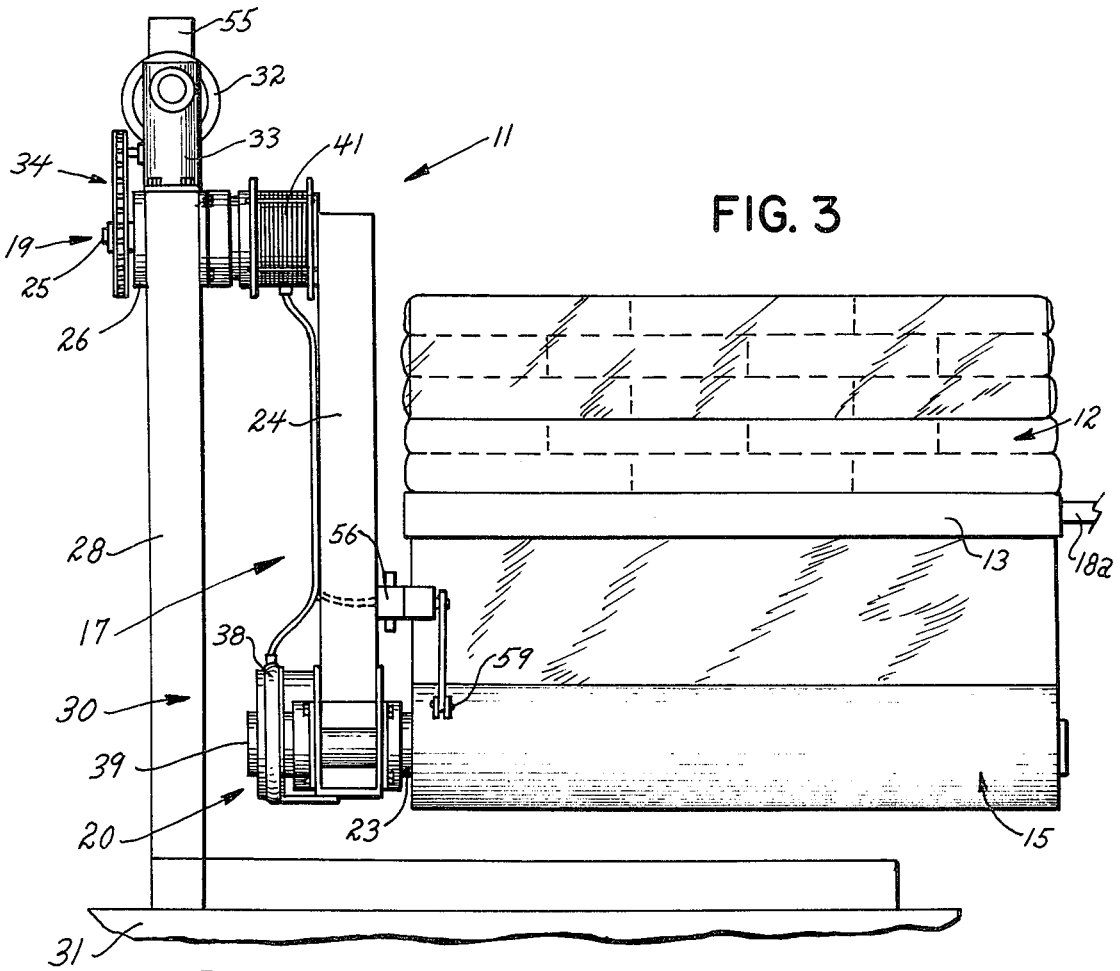
FIG. 3 is a left-side elevational view of the apparatus shown in FIG. 2.

As further shown in FIGS. 1–3, the product 10 comprises a palletized load of plural bags 12 built upon a skid 13 and has its generally horizontally arranged top and bottom portions and two of its generally vertically arranged side portions overwrapped by a band 14 formed of plural layers of a stretched sheet of stretchable material 15 wherein the trailing edge **16*t* of the stretched material 15 is fastened to at least one of the previously wrapped band-forming layers of the material 15. In the illustrated form, the material is of a type that is heat laminateable and this fastening is performed by heat sealing means (not shown). However, it should also be understood that this fastening might also be accomplished by other fastener means, such as adhesives, staples, etc. (not shown), or even without the need for any additional fastener means if the material 15** is of the so-called "self-clinging" type.

Figure 4:
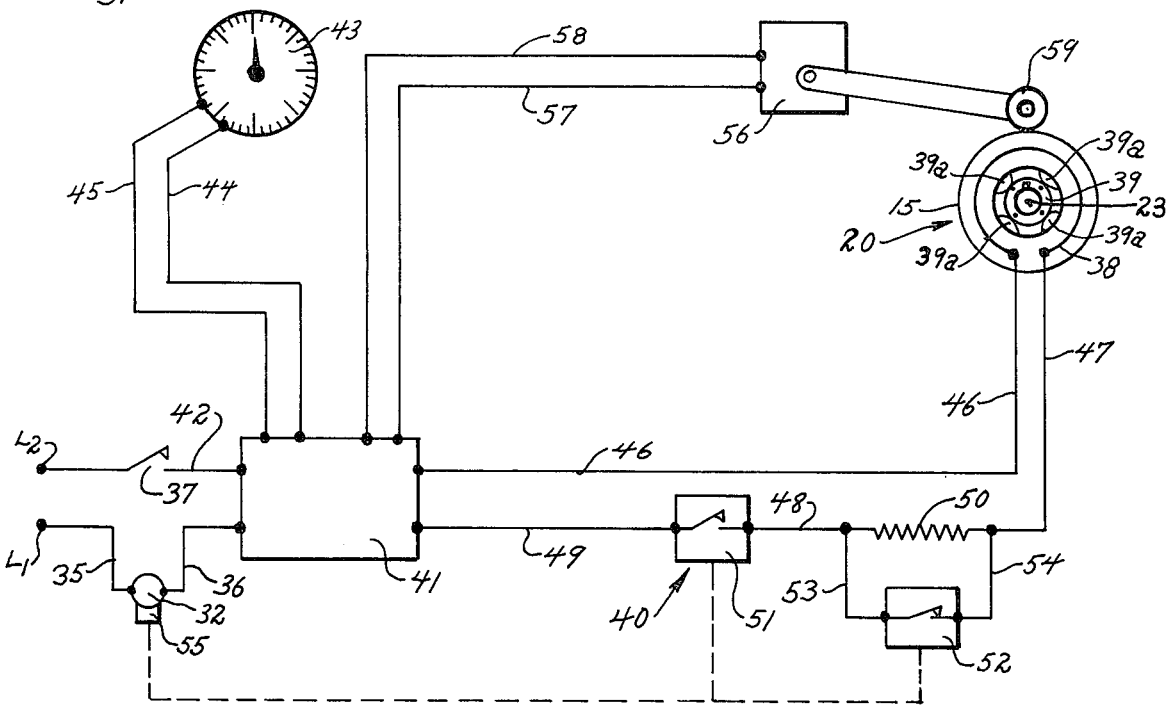
FIG. 4 is a diagrammatic showing of a presently preferred form of control means for the apparatus shown in FIGS. 1–3.

As illustrated in FIGS. 1–4, the presently preferred form of apparatus 11 that can be employed to perform the process of the present invention to produce the product 10 basically includes dispenser means 17 for locating a rolled-up sheet of the material 15 adjacent to support means, such as the forks **18*a* and 18*b* of the illustrated fork-lift truck 18, for supporting the package load 12; drive means 19 for initiating relative movement between the dispenser means 17 and the load support means 18*a* and 18*b* to cause a sufficient amount of the material 15 to be dispensed from the dispenser means 17 to overwrap at least a part of the load 12; and restricting means 20, such as the electromagnetic brake mechanism best shown schematically in FIG. 4, for restricting the relative movement between the dispenser means 17 and the load support means 18*a* and 18*b* such that the dispensed material 15 will be stretched (FIG. 2) but permitting a sufficient amount of the stretched material 15 to be dispensed from the dispenser means 17 to provide the band 14 comprising plural layers of the material 15 around the load 12 (FIG. 1**).

For the safety of operating personnel, the apparatus 11 is preferably enclosed within a removable protective guard 21, as shown in FIG. 1, that has an opening 22 for admitting and receiving the load 12 and skid 13 bearing load support means **18*a* and 18*b*, to and from the area adjacent to the apparatus 11**.

As illustrated, the dispenser means 17 comprises a generally horizontally-arranged roller-mounting member 23 which is rotatably journalled in and suspended from the outer end of an arm 24 that has its inner end connected to a generally horizontally-arranged drive shaft 25. This drive shaft 25 is, in turn, rotatably journalled in bearing means 26 mounted in a generally horizontal cross-bar 27 that is connected between a pair of uprights 28 and 29 which form frame means 30 that support the dispenser means 17 erected on a base, such as a building floor 31, in such a manner that the rolled-up sheet of material 15, when carried by the roller-mounting member 23, will be sufficiently elevated above the base or floor 31 to enable it to move between the bottom of the fork-supported, load-bearing skid 13 and the base or floor 31. The arm 24 is made of a sufficient length to permit the rolled-up sheet of material 15, when carried by the roller member 23, to move about the top of the tallest load 12 intended to be borne by the fork-supported load-bearing skid 13.

As further shown in FIGS. 1 and 2, the dispenser means drive shaft 25 and the opening 22 in the protective guard 21 ae preferably arranged with respect to one another such that the generally horizontal central axis of the drive shaft 25 will be generally aligned over and parallel to the generally horizontal central axis of the fork-supported load-bearing skid 13.

As further illustrated in FIGS. 1–4, electrically-powered drive means 19 are preferably provided for rotating the drive shaft 25 and thus moving the dispenser means arm 24 and its material sheet roller-mounting member 23 relative to the skid 13 and the load 12 bearing support means 18*a* and 18*b* about the generally horizontal axis of the drive shaft 25. The illustrated form of electrically-powered drive means 19 includes an electric motor 32 which is mechanically interconnected through suitable reduction gearing 33 and chain and sprocket means 34 to the rotary drive shaft 25, that are supported atop the generally horizontal cross-bar 27 of the frame means 30. The electric motor 32 is connected across electric power lines $L_1$ and $L_2$ by conductors 35 and 36 in series with first control means comprising a normally-open electric switch 37.

While it should be understood that various other substantially equivalent means could be substituted, such as clutch means, etc., the presently preferred form of the restricting means 20 that are employed in the apparatus 11 comprise electromagnetic brake means which are provided adjacent the point where the material sheet roller-mounting member 23 is rotatably journalled in and suspended from the outer end of the dispenser means arm 24. These restricting means 20 comprise an electromagnetic coil 38 that is fixed on the back of the outer end of the arm 24 and surrounds a brake member-carrying rotor 39 which can rotate freely within the coil 38 but is fixed to the end of the material sheet roller-mounting member 23 which is rotatably journalled in the outer end of the arm 24.

Unless electrical current is applied to the coil 38, the brake member-carrying rotor 39 and the material sheet roller-mounting member 23 to which it is fixed can rotate freely. However, application of the electrical current through the coil 38 will produce an electromagnetic force which will pull the brake members 39*a* that are pivotally carried by the rotor 39 against the inner diameter of the coil 38 (see especially FIG. 4). This, in turn, will cause a braking or restricting of the rotation of the rotor 39 and the material sheet roller-member 23 to which it is fixed. Furthermore, the degree of such braking or restricting will be directly proportional to the intensity of the electrical current that is applied to the coil 38.

In further accordance with the present invention, second control means 40 (see especially FIG. 4) are provided for selectively adjusting the intensity of the electrical current that is applied to the coil 38 and, thereby, thus, also, selectively adjusting the degree of braking or restricting of the rotation of the rotor 39 and the material sheet roller-mounting member 23 to which it is fixed, and also the degree of elongation or stretching of the shrinkable material carried by the material sheet roller-mounting member 23 and dispensed by the dispenser means 19 of the apparatus 11 of the present invention.

As best shown in FIG. 4, the second control means 40 comprises a Direct Current (D.C.) power supply 41 that is connected in electrical series across the two power supply lines $L_1$ and $L_2$ with the drive means motor 32 by conductors 35, 36, and 42 through the normally-open electric switch 37 of the first control means. This second control means 40 also includes a "dial and pointer" type rheostat 43 which is electrically connected to it through conductors 44 and 45 for selectively adjusting its output. This D.C. power supply 41 has its output connected across the coil 38 of the electromagnetic brake or restricting means 20 by conductors 46, 47, 48 and 49 in electrical series with a resistor 50 and a normally-open, timer-actuated, first relay 51. A normally-closed, timer-actuated, second or by-pass relay 52 is electrically connected around the resistor 50 by conductors 53 and 54. Both the first 51 and the second 52 relays are mechanically connected to a timer 55 that is started by energization of the dispenser drive means motor 32 by closure by the operator of the normally-open first control means switch 37. As further illustrated, the D.C. power supply 41 for the second control means 40 is also provided with a potentiometer 56 that is mounted adjacent to the outer end of the dispenser means arm 24 and is electrically connected by conductors 57 and 58 across the output of the D.C. power supply 41. This potentiometer 56 has a sensor which comprises a pivotally-mounted wheel 59 that contacts and, thus, monitors the diameter of the rolled-up sheet of material 15 which is carried by the roller member 23 of the dispenser means 17.

While it should be understood that various stretchable materials may be employed for the sheet of overwrapping material 15, good results can be obtained in accordance with the present invention by employing a polyethylene film having thickness in a range between 0.00075 and 0.004 inches and a specific gravity in a range from 0.915 through 0.922 which can be stretched in an elongation range of from 2% through 100% under from 600 to 2,000 P.S.I. of force.

Basically, the novel process that is provided in accordance with the present invention comprises the steps of: placing a load on a support; locating a rolled-up sheet of a stretchable material on dispenser means adjacent to the support; withdrawing a leading edge of the material from the dispenser means and holding the leading edge against the load; and initiating relative movement between the dispenser means and the support means but restricting the relative movement such that the material will be stretched and causing a sufficient amount of the stretched material to be dispensed from the dispenser means to provide a band comprising plural layers of the material around the load.

To produce a product, such as the illustrated unitary package 10, by the novel process of the present invention with the illustrated apparatus 11, an operator first places a load, such as the illustrated palletized load of plural bags 12 built up on the skid 13, on a support, such as the illustrated forks 18*a* and 18*b* of the fork-lift truck 18, by engaging the forks 18*a* and 18*b* within openings provided in the skid 13.

The fork-lift truck 18 then is operated to insert the fork-supported, load-bearing skid 13 through the opening 22 in the protective guard 21 to generally align the generally horizontal central axis of the dispenser means drive shaft 25 above and parallel to the generally horizontal central axis of the fork-supported, load-bearing skid 13, with, of course, the forks 18*a* and 18*b* being sufficiently elevated above the base or building floor 31 such that a rolled-up sheet of material 15, when carried by the roller-member 23 of the dispenser means 17, can move between the bottom of the fork-supported, load-bearing skid 13 or the base or floor 31.

Next, the operator mounts a rolled-up sheet of the stretchable material 15 on the material sheet roller-mounting member 23 of the dispenser means 17, preferably, one having a width dimension sufficient to cover the illustrated fore-and-aft horizontal dimension of the fork-supported, skid-borne load 12.

Then, the operator withdraws the leading edge **16*a* of the rolled-up sheet of material 15 from the dispenser means 17 and holds that leading edge against the fork-supported package load 12 of palletized plural bags 12, preferably, by inserting it between two contiguous horizontal rows of the palletized bags 12, as best shown in FIG. 2**.

Next, the operator selects the desired degree of tension or stretching that is to be applied to the material sheet 15 by the restricting means 20 of the dispenser means 17, by setting the pointer of the "dial and pointer" type rheostat 43 of the second control means 40 to the appropriate position therefor.

Then, the operator closes the normally-open switch 37 of the first control means, thus, immediately electrically energizing the dispenser drive means motor 32 and its associate timer 55 and, also, electrically connecting the second control means 40 across the power lines $L_1$ and $L_2$, but not, at that time, energizing the restricting means coil 38. This immediate energization of the drive means motor 32 causes immediate free rotation of the dispenser means drive shaft 25 about its generally horizontal axis and, in turn, concurrent movement of the dispenser means arm 24 that is fixed to it, and temporary free rotary movement between the material sheet mounting roller 23 and the arm 24 in which it is journalled.

The timer 55 is preferably so set such that the normally-open first relay 51 of the second control means 40 will remain open, and thus prevent flow of D.C. current from the D.C. power supply 41 through the coil 38 of the electromagnetic brake or restricting means 20, until the dispenser means drive shaft 35 has rotated sufficiently to permit the sheet 15 carried by the roller member 23 of the dispenser means to overwrap approximately 270° of the area of the package load 12 to be eventually overwrapped by plural layers of it about the generally horizontal axis of the elevated fork-supported load 12. However, as this 270° mark is passed, the timer 55 then acts to close the normally-open first relay 51 of the second control means 40, while retaining the normally-closed second relay 52 in its normally-closed position. This then applies all of the desired amount of the current that has been selected by the operator's previous setting of the "dial and pointer" type rheostat 43, from the D.C. power supply 41 to the electromagnetic coil 38 of the brake or restricting means 20 and thus, then, causes the brake members **39*a*, which are carried by the brake rotor 39 that is attached to the material sheet roller-mounting member 23, to be drawn into frictional contact with the inner surface of the coil 38. This, of course, results in restriction of relative movement between the material sheet mounting roller member 23 and the dispenser arm 24 and, hence, also between the dispenser means 17 and the fork-supported load 12, which, in turn, causes tensioning or stretching of the material sheet 15 as it continues to be dispensed by the dispenser means 17 to form the plural layered load overwrapping band 14**.

The horsepower of the dispenser means drive motor 32 and the braking power of the electromagnetic restricting means 20 are so chosen that the drive means motor 32 will, for any degree of elongation of the dispensed material sheet 15 selected by operation of the "dial-and-pointer" type rheostat 43, be sufficiently powerful to overcome the braking force of the restricting means 20 and, thus, will permit a sufficient amount of the stretched material 15 to be dispensed from the dispenser means 17 to cause the band 14 comprising plural layers of the stretched material 15 (FIG. 1), to be overwrapped around the load 12 and its skid 13. The number of revolutions of the dispenser means drive shaft 25, and, consequently, the number of layers of the material sheet 15, which form the load overwrapping band 14, are, of course, controlled by the timing of reopening of the switch 37 of the first control means.

The timer 55 is preferably set such that it will operate to open the normally-closed second relay 52 of the second control means 40 within approximately 90° of the total desired amount of rotation of the dispenser means drive shaft 25, to thus direct the output of the D.C. power supply 41 to the coil 38 of the brake or restricting means 20 through the resistor 50 and, thus, considerably reduce the braking force between the coil 38 and the brake rotor 39 and the material sheet roller member 23 that is fixed to it, and, consequently, also, thus, considerably reduce the tensioning or elongation of the last portion of the load-overwrapping material sheet 15 dispensed by the dispenser means 17.

Preferably, the trailing edge **16*t* of the material sheet 15, which is being dispensed by the dispenser means 17, is next fastened, as by heat sealing means, adhesive means, or mechanical fastening means, unless it is of the so-called "self-clinging" type, to at least one of the previously dispensed layers of the band 14 beneath it, and, then, severed from the dispenser means 17, by cutter means (not shown), such as scissors, a knife, or the like carried by the operator, who, finally, terminates dispensing operations by re-opening the first control means switch 37 to, thus, simultaneously de-energize both the dispenser means drive motor 32 and the second control means 40**.

The fork-lift truck 18 is now operated to withdraw the unitary package 10, which now has a band 14 formed of elongated, plural layers of the dispensed stretchable material 15 overwrapped around both the bags 12 and the skid 13 on which they are supported, from adjacency to the apparatus 11 through the opening 22 in the protective guard 21 to warehouse storage or loading in a transport vehicle (not shown), such as a railroad car, truck, and the like.

The apparatus 11 is now ready to repeat the aforedescribed novel process of the present invention. Of course, should the operator of the apparatus 11, desire to increase or decrease the degree of elongation of the plural layers of the material sheet 15 to be dispensed by the apparatus 11 during subsequent performance of the aforedescribed process, he may do so merely by appropriate resetting of the "dial-and-pointer" type rheostat 41 of the second control means 40. The degree of elongation of the layers of the material sheet 15 which are dispensed by the dispenser means 17 of the apparatus 11 to form the band 14 will, of course, be directly proportional to the degree of intensity of the electric current that is applied to the coil 38 of the electromagnetic brake or restricting means 20, as determined by the setting by the operator of the rheostat 41.

The constant contact of the sensor wheel 59 of the potentiometer 56 with the rolled-up sheet of the material 15 outside diameter will adjust the output of the D.C. power supply 41 to the braking coil 38 such that the tensioning or elongation of the dispensed material sheet will be unaffected as the outside diameter of the rolled-up sheet diminishes.

It should be apparent that while there has been described what is presently considered to be a presently preferred form of the present invention in accordance with the Patent Statutes, changes may be made in the disclosed process, apparatus, and product produced thereby without departing from the true spirit and scope of this invention.

For example, other equivalent forms of apparatus might be substituted for the illustrated apparatus 11. Various other materials might be used for the material 15, so long as they are of a type that is stretchable. It is, therefore, intended that the appended claims shall cover such modifications and applications that may not depart from the true spirit and scope of the present invention.

What is claimed is:

1. A process of making a unitary package of a load consisting of a plurality of members, comprising the steps of:

a. placing a load on a support;

b. locating a rolled-up sheet of a stretchable material on dispenser means adjacent to said support;

c. withdrawing a leading edge of said material from said dispenser means in a substantially unstretched condition and partially wrapping said load with said material which is in a substantially unstretched condition d. initiating relative movement between said support and said dispenser means and restricting such relative movement so that said material will be stretched causing a sufficient amount of said stretched material to be dispensed from said dispenser means to provide an overwrap band comprising a plurality of layers of material around said load;

e. removing said restricting influence and subsequently continuing said relative movement without restriction so that said material will be dispensed from said dispenser means in substantially unstretched condition to provide an overwrap band portion which does not encircle said load;

f. securing said material to at least one of the previously dispensed band-forming layers; and g. severing said material from said dispensing means to form a unitary package.

2. The process of claim 1 wherein said load support is substantially stationary and said dispenser means is moved around said load support means.

3. The process of claim 1, wherein said load support is arranged generally horizontally with respect to said dispenser means.

4. The process of claim 1 wherein said material comprises polyethylene.

5. The process of claim 1 wherein said material is stretched in an elongation range of 2% through 100% by said restricting.

6. Apparatus for making a unitary package of a load comprising a plurality of units comprising a frame, dispensing means mounted to said frame, said dispensing means comprising, an arm rotatably mounted to said frame, a shaft rotatably mounted to said arm, said shaft being adapted to receive and hold a roll of plastic film, drive means connected to said arm and adapted to rotatably uninterruptedly drive said arm so the roll of plastic film mounted on said shaft will travel in a continuous circular path, brake means mounted to said shaft, said brake means being adapted to selectively restrict the rotation of said film holding shaft when said arm is rotated to place tension on film being unwrapped from said roll and wrapped around said load, sensing means mounted to said frame and electrically connected to said brake means, said sensing means being adapted to determine the thickness of a roll of plastic film placed on said film holding shaft and control the force that said brake means exerts on said holding shaft to provide a continuous substantially uniform tension of said film to uniformly stretch said film, a second sensing means connected to said brake means to selectively energize and deenergize said brake means during rotation of said arm and shaft to apply at least two separate predetermined uniform tensions on said film during every package wrapping cycle, said second sensing means comprising timer means and switch means electrically connected to said timer means for energizing and deenergizing said brake means.

7. Apparatus as claimed in claim 6 wherein said brake means is an electromagnetic brake mechanism.

8. Apparatus as claimed in claim 6 wherein said sensing means comprises a potentimeter, a sensor wheel mounted to said potentiometer and adopted to engage the outside of said film roll and circuit means connecting said potentimeter to said brake means.

* * * * *